US007572090B2

(12) United States Patent
Silberbauer

(10) Patent No.: US 7,572,090 B2
(45) Date of Patent: Aug. 11, 2009

(54) METHOD FOR PRODUCING A PRINTED END PRODUCT COMPRISED OF ONE OR MORE PRINTED PRODUCTS AND DEVICE FOR PERFORMING THE METHOD

(75) Inventor: Günther Silberbauer, Oftringen (CH)

(73) Assignee: Müller Martini Holding AG, Hergiswil (CH)

( * ) Notice: Subject to any disclaimer, the term of this patent is extended or adjusted under 35 U.S.C. 154(b) by 1269 days.

(21) Appl. No.: 10/174,678

(22) Filed: Jun. 19, 2002

(65) Prior Publication Data

US 2003/0002955 A1 Jan. 2, 2003

(30) Foreign Application Priority Data

Jun. 28, 2001 (EP) ..... 01810628

(51) Int. Cl.
*B42B 2/00* (2006.01)

(52) U.S. Cl. ..... 412/35; 412/9

(58) Field of Classification Search ..... 412/1, 412/3, 4, 6, 9, 18, 19–20, 33, 35; 270/52.18, 270/52.26, 52.27, 52.28, 52.29, 52.3
See application file for complete search history.

(56) References Cited

U.S. PATENT DOCUMENTS 2,366,064 A * 12/1944 Sieb ..... 112/21
4,704,973 A * 11/1987 Horst ..... 112/21
4,735,406 A * 4/1988 Weber ..... 270/52.3
5,464,199 A * 11/1995 Stauber ..... 270/52.18
5,678,813 A * 10/1997 Osako et al. ..... 270/52.16
5,772,195 A * 6/1998 Mueller ..... 270/52.16
6,095,740 A * 8/2000 Hollenstein et al. ..... 412/4
6,612,559 B2 * 9/2003 Boss ..... 270/52.18

FOREIGN PATENT DOCUMENTS

| | | |
|---|---|---|
| DE | 3616566 | 12/1986 |
| DE | 4434178 | 3/1996 |
| DE | 197 25 607 A1 | 12/1998 |
| EP | 0095603 | 12/1983 |
| EP | 0992365 | 2/1994 |
| EP | 0962334 | 12/1999 |
| EP | 1005984 | 6/2000 |
| WO | 0134403 | 5/2001 |

OTHER PUBLICATIONS

"Industrielle Buchbinderei" (Industrial Book Binding), Verlag Beruf+Schule, 1997, pp. 176-186.

* cited by examiner

*Primary Examiner*—Dana Ross
*Assistant Examiner*—Jamila Williams
(74) *Attorney, Agent, or Firm*—Friedrich Kueffner

(57) ABSTRACT

In a method for manufacturing a printed end product containing a single printed product or several printed products, collected astraddle and supplied sequentially, and bound by stitching, the printed products are collected in a predetermined sequence required for forming the printed end product along a common conveying path. Subsequently, the printed products are stitched. A circulating collecting support is provided which is supplied by a feeding device with spread-apart printed products. After the collecting step is complete, the collected printed sheets are moved on the conveying path to the stitching location.

13 Claims, 3 Drawing Sheets

METHOD FOR PRODUCING A PRINTED END PRODUCT COMPRISED OF ONE OR MORE PRINTED PRODUCTS AND DEVICE FOR PERFORMING THE METHOD

BACKGROUND OF THE INVENTION

1. Field of the Invention

The invention relates to a method for manufacturing a printed end product, in particular, journals, brochures or books, produced of one printed product or of several printed products, collected astraddle and sequentially supplied, and bound by stitching.

2. Description of the Related Art

Such methods are performed with so-called gather stitchers as described, for example, in "Industrielle Buchbinderei" (Industrial Book Binding), verlag Beruf+Schule, 1997, pp. 176-186.

The different printed products are supplied by several feeders, which are arranged along a collecting path, on parallel supply sections to a collecting device arranged upstream of the stitching apparatus. These gather stitchers receive the printed products from stacks or other storage devices.

For an economical processing of printed products with gathers stitchers, a high number of printed end products is necessary, i.e., the required number of printed end products determines the method to be employed. For example, currently, the general rule is still applied that up to a number of 2000 prints of the same printed end product a digital printing method is more economical in comparison to offset printing because this requires significantly shorter set-up times and, for a corresponding number of prints, an average processing time of approximately eight hours.

SUMMARY OF THE INVENTION

It is an object of the present invention to achieve in connection with a method of the aforementioned kind an optimal economic efficiency for a small number of prints in comparison to other successful manufacturing methods.

In accordance with the present invention, this is achieved in that the printed products, in the sequence predetermined for forming the printed end product, are collected via a common conveying path and are then stitched. This means that the processing of the printed products is continuously carried out up to the point of collecting and is carried out subsequently in a stepwise manner during the time in which the printed products are collected.

For achieving a substantially continuous supply of the sequence of the printed products determined for forming a printed end product, they are printed advantageously in a digital printing device and subsequently, during collection of the printed product for the next printed end product, are stitched. Preferably, collecting and stitching are performed at locations spaced from one another along the conveying path.

For performing the method, a device is provided according to the invention which is comprised of a feeding device comprising an opening device, transferring the printed products on the conveying path in a spread-apart arrangement onto a conveying-active collecting device with a collecting support, wherein the collecting support, arranged below the opening device so as to be rotatable about an axis of rotation arranged transversely to the feeding direction of the printed products, is driven in a stepwise fashion on a section of the conveying path defined between a collecting location of the supplied printed products and a stitching location. In this way, a compact and simple configuration of the device can be obtained. Moreover, with the device according to the invention it is possible to process printed products produced by an off-line method to stitched printed end products.

Preferably, several collecting supports are provided and arranged about the axis of rotation so that they have to travel shorter travel distances and can be driven with an acceptable speed.

Alternatively, the section of the conveying path between the collecting location and the stitching location can be formed by at least one traction means circulating about a deflection drum of a traction mechanism on which collecting supports are fastened at regular spacings.

It was found to be expedient when the stitching location and one collecting support form a stitching device; this is beneficial in regard to a simple and compact configuration of the device.

In this connection it is advantageous when the stitching location comprises a stitching device comprised of a deforming device for deforming a wire section into a staple and a drive device driving and pushing the deformed wire section as well as a bending device provided on the collecting support.

Instead of performing an inaccurate drop of the printed end products, the end of the conveying path at the downstream side is formed as a delivery located downstream of the stitching location.

Advantageously, the delivery opens into a conveying arrangement which ensures the further transport of the printed end products.

The delivery can be expediently a lifting device which removes the printed end products from the collecting support for which purpose, for example, a knife acting in a controlled fashion on the inner folded edge of the printed end product is particularly suitable.

In order to be able to provide the printed end product online with a cover, it is expedient when the collecting location has a cover folder feeder correlated therewith with which the cover to be folded is placed from the side onto the printed products resting loosely on the collecting support. Cover folder feeders or the like are described, inter alia, in the aforementioned book "Industrielle Buchbinderei".

When using at least one traction means for forming the conveying path, a cover folder feeder can be arranged between the feeding device for the printed products and the stitching path.

The conveying end of the feeding device can preferably be formed by an opening device of a printed sheet feeder or by a cycled transporting device. Both types are known; the latter, inter alia, from European patent application 0 095 603 A1.

In order for the printed end product to be produced to have the desired number of printed products, the device is connected to a computer-controlled device for performing the inventive method.

BRIEF DESCRIPTION OF THE DRAWING

In the following the invention will be explained by means of two embodiments with the aid of the drawing, wherein reference is being had to the drawing in regard to all details not mentioned in the description. The drawing shows in.

DESCRIPTION OF THE PREFERRED EMBODIMENTS

Figure 1:
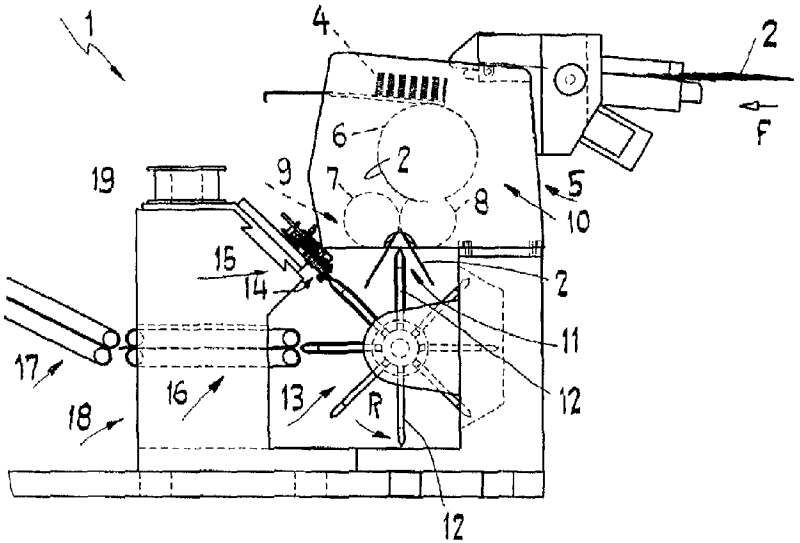
FIG. 1 a side view of a device provided for performing the method according to the invention.

FIG. 1 shows schematically a device 1 for producing a printed end product 3, for example, journals, brochures or books, comprised of several printed products 2 supplied in a certain sequence and stitched by wire. The printed products 2 to be processed are preferably supplied from a digital printing machine (not illustrated) in the direction F in an imbricated flow, or individually, to a magazine 4. The employed feeding means for this purpose are known and are therefore not described in this context. The magazine 4 is part of a printed sheet feeder 5 which is comprised of a conveying drum 6 removing the printed products 2 from the magazine 4 and an opening device 9 which is comprised of two opening drums 7, 8. Printed sheet feeders 5 of this kind are known in the field of gather stitchers and form in the present case the feeding device 10 of the device 1. As an alternative, an embodiment as disclosed and described in European patent application 0 095 603 A1 could be used as the feeding device 10.

FIG. 1 shows how a printed product 2 spread apart by the opening device 9 leaves the printed sheet feeder 5 or the feeding device 10 and the next printed product is transported by the conveying drum 6 into the engaging area of the opening device 9. The supply section on the conveying path of the printed product 2 ends initially on a collecting location 11 which is defined by a collecting support 12 of the collecting device. The collecting support 12 is comprised of a radially projecting stay of a circulating rotor 13 which has several collecting supports 12 distributed about its circumference. The collecting supports 12 have at their free ends a saddle-shaped area on which the printed products 2 are placed astraddle. The rotational direction of the rotor 13 is indicated by the arrow F. The rotational movement of the rotor 13 is carried out stepwise at a spacing correlated with that of the collecting supports 12.

After collection of the number of printed products 2 required for the printed end product 3 on a collecting support 12, the collecting support 12 is moved on the conveying path one step farther and reaches a stitching location 14. The stitching location 14 is characterized by a stationarily arranged deforming device for deforming a wire section into a U-shaped profile and by a drive device cooperating therewith for driving or pushing the U-shaped wire section through the fold of the printed end product 3 formed of at least one printed product 2 comprised of several sheets. Both devices are not illustrated in the drawing, but they are well known in connection with gather stitchers. Together with the collecting support 12 which is formed at its free end as a deforming device, a stitching device 15 results which is adjustable with respect to the stitching spacing. The principle of the stitching process which is carried out during the time period during which on the trailing collecting support 12 printed products 2 for the next printed end product 3 are collected is known in general and described, inter alia, in the aforementioned book "Industrielle Buchbinderei". As shown in the illustration in FIG. 1, the rotor 13 rotates by 45° in the counterclockwise direction so that the collected printed products 2 reach the stitching location 14 on the conveying path. Between the collecting location 11 and the stitching location 14 a stepwise rotational movement of the collecting supports 12 is carried out which is generated as a result of the time period required for collecting the printed products 2 to form a complete printed end product 3.

Figure 2:
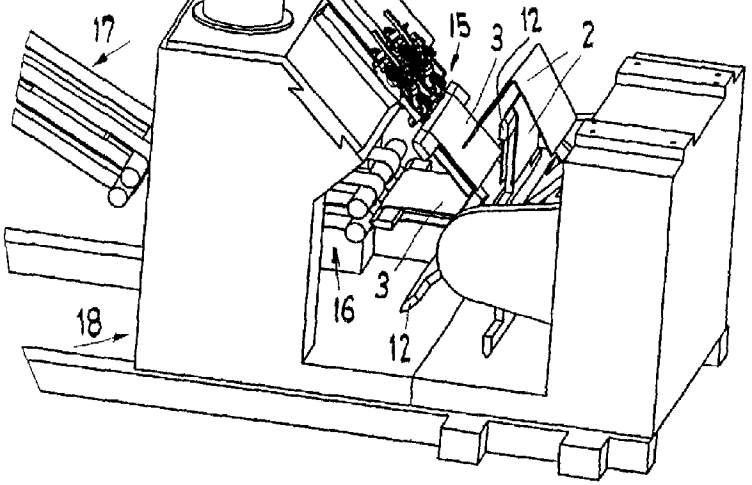
FIG. 2 a perspective illustration of the device according to FIG. 1.

After stitching, according to a further method step the removal of the printed products 3 from the collecting support 12 is carried out. For example, a telescoping knife or the like, configured to be extended with its free end, can be used for this purpose, which knife or the like acts on the inner folded edge of the printed end product 3 and transfers it onto a transport means 16. The transport means 16 is comprised of a circulating pair of conveying belts forming a conveying channel which transfers the printed end products 3 onto an adjoining conveying device 17 of the same type. In supplementing the above, it should be noted that the device 1 has a frame 18 on which the described device components are fastened. On the frame 18 one of two reels 19 with the wire required for the wire sections can be seen. In FIG. 2, the details described in connection with FIG. 1, with the exception of the feeding device 10, can be seen in a perspective illustration.

Figure 3:
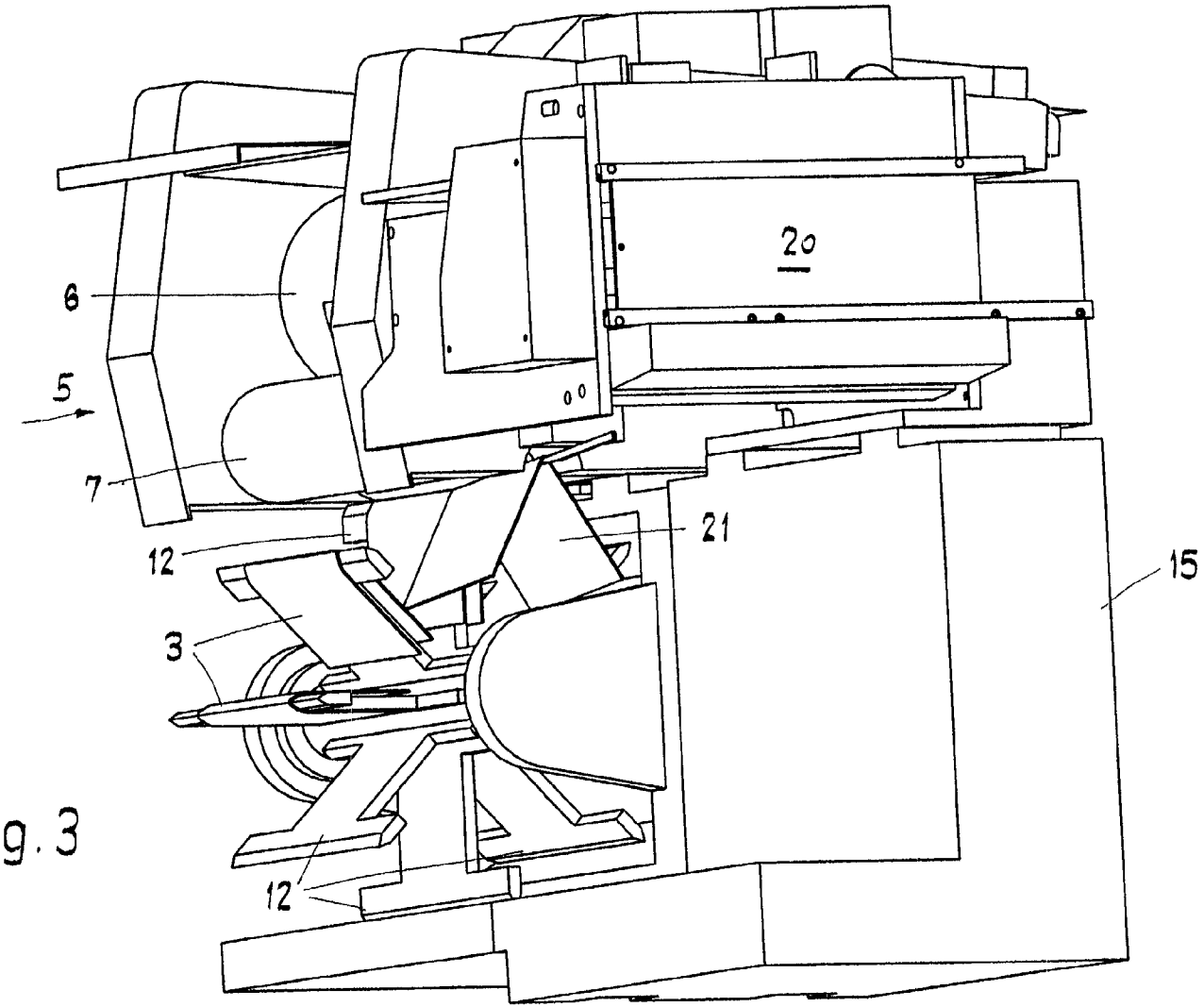
FIG. 3 a detailed perspective illustration of the device according to FIG. 2 in the feeding/collecting area of the printed products.

FIG. 3 illustrates the printed sheet feeder 5 illustrated in FIGS. 1 and 2 as the feeding device 10 and the rotor 13 with the circulating collecting supports 12 arranged downstream. Laterally displaced, in the foreground, a cover folder feeder 20 is connected to the frame 15 which places a folded cover 21 onto the collected printed products 2 before the rotor 13 is moved one method step farther for stitching.

Figure 4:
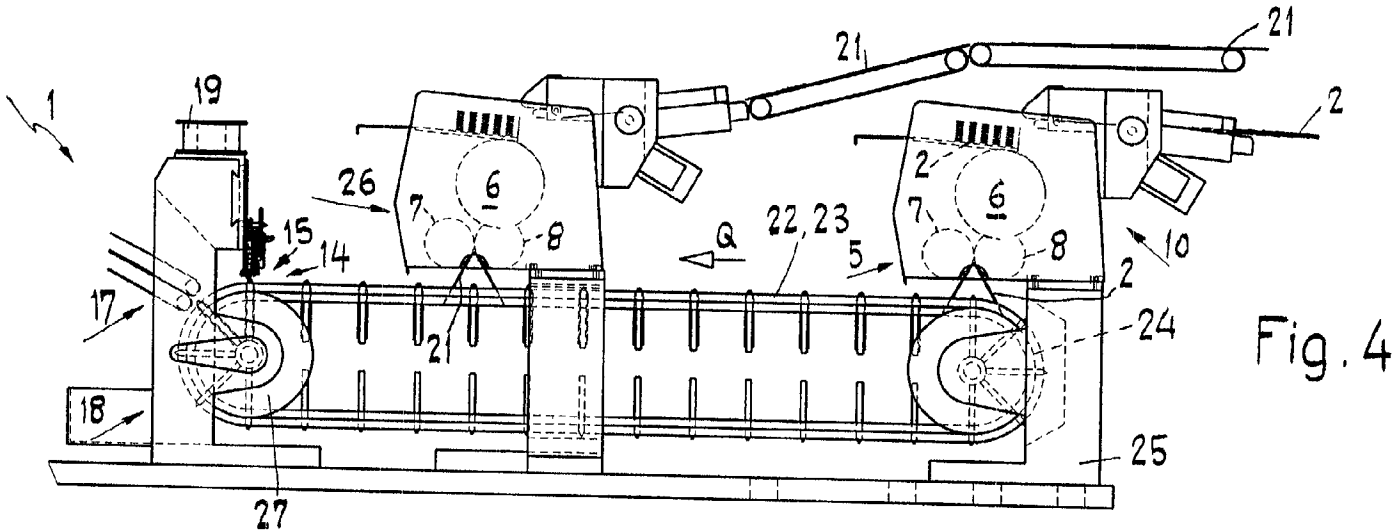
FIG. 4 a side view of an alternative device for performing the method according to the invention.

In FIG. 4, an alternative embodiment of the device 1 according to the invention is illustrated. It has, in contrast to FIGS. 1 through 3, a traction mechanisms, comprised of two parallel circulating traction means 22, 23 and driven in a stepwise fashion, instead of the rotor 13. The traction means 22, 23 are connected to one another by stay-shaped collecting supports 12 extending transversely to the conveying direction Q. Along the upper conveying run formed by the traction means 22, 23, a feeding device 10 for the printed products 2 in the form of a printed sheet feeder 5 is arranged at the upstream end. In order to provide a space-saving arrangement, the feeding device 10 is arranged on a frame 25 above a deflection drum 24 forming the end of the traction mechanism, the feeding device 10 being placed onto the frame 25.

The feeding device 10 has downstream thereof along the upper conveying run a cover feeder 26 in front of the stitching location 14 with which the folded covers 21, as in the feeding device 10, are placed onto the collected printed products 2 in a spread-apart arrangement.

Of course, in an embodiment as illustrated in FIG. 4, by eliminating the cover feeder 26 between the feeding device 10 and the stitching location 14 instead a cover folder feeder 20—as illustrated in FIG. 3—could be used so that the length of the traction mechanism could be significantly shortened.

In an embodiment changed in this way or in the device 1 illustrated in FIG. 4, the stitching device 15 is also formed by a stationarily arranged forming and driving device (not illustrated) and a bending device integrated into the collecting support 12; instead of a rotor 13 a driven deflection drum 27 is provided.

Figure 5:
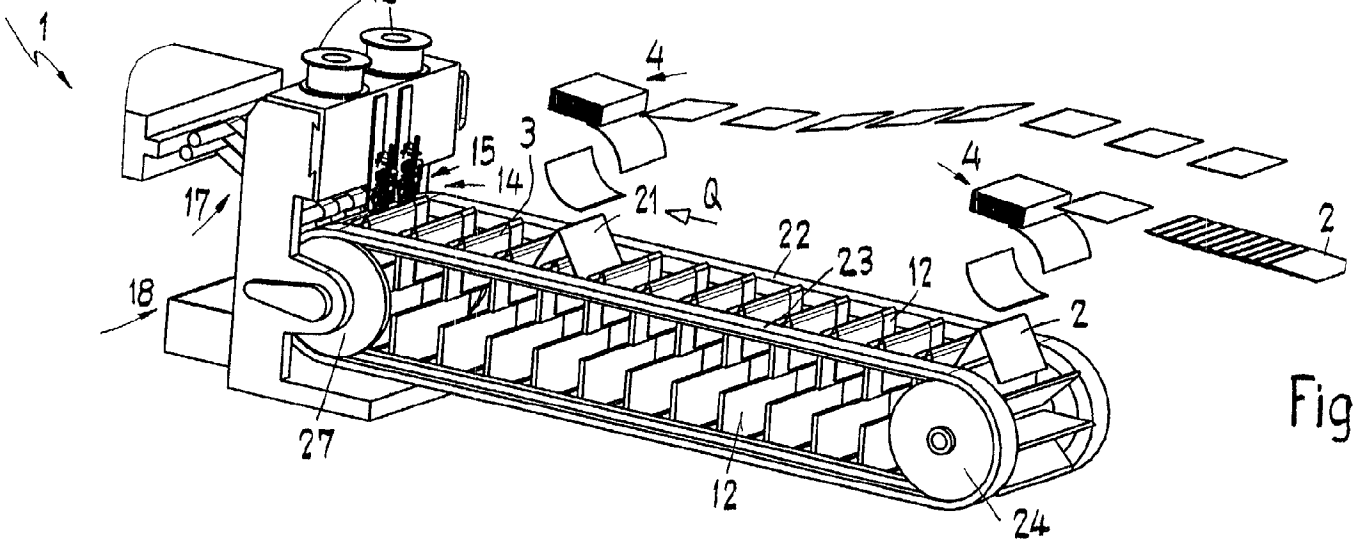
FIG. 5 a perspective illustration of the device according to FIG. 4.

The further advantages of the embodiment according to FIGS. 1 through 3 are contained also in the alternative device 1 according to FIGS. 4 and 5. Further explanations in regard to FIGS. 4 and 5 therefore seem to be unnecessary.

A control device 28 is illustrated in FIG. 4 which has a computer part R and a control part S which is connected in a control-effecting way to the individual components of the device 1.

While specific embodiments of the invention have been shown and described in detail to illustrate the inventive principles, it will be understood that the invention may be embodied otherwise without departing from such principles.

What is claimed is:

1. A device for manufacturing a printed end product comprised of a single printed product or several printed products, collected astraddle and supplied sequentially, and bound by stitching, wherein the printed products are collected in a predefined sequence required for forming the printed end product along a common conveying path and are subsequently stitched, the device comprising:

a feeding device comprising an opening device configured to transfer printed products on a conveying path in a spread-apart arrangement onto a collecting device;

wherein the collecting device has one or more collecting supports arranged below the opening device so as to be rotatable about an axis of rotation arranged transversely to the feeding direction of the printed products; and wherein the one or more collecting supports are driven in a stepwise fashion on a portion of the conveying path, which portion of the conveying path is defined between a collecting location of the printed products and a stitching location, wherein the stitching location and one of the collecting supports form a stitching device.

2. The device according to claim 1, wherein several of the collecting supports are provided and arranged about the axis of rotation.

3. The device according to claim 1, wherein the section of the conveying path is formed by a circulating rotor comprising several of the collecting supports.

4. The device according to claim 1, comprising a traction mechanism having at least one circulating traction means and a deflection drum about which the at least one traction means is deflected, wherein the portion of the conveying path is formed on the at least one traction means, and wherein several of the collecting supports are fastened at a regular spacing to the at least one traction means.

5. The device according to claim 1, wherein the stitching device comprises a deforming device for deforming a wire section into a deformed wire section and a drive device advancing the deformed wire section as well as a bending device provided on the collecting support.

6. The device according to claim 5, wherein the conveying path has a downstream end formed by a delivery arranged downstream of the stitching location.

7. The device according to claim 6, wherein the delivery opens into a conveying arrangement.

8. The device according to claim 6, wherein the delivery has a lifting device removing the printed end product from the one or more collecting supports.

9. The device according to claim 8, wherein the lifting device is a knife acting in a controlled fashion onto an inner folded edge of the printed end product.

10. The device according to claim 1, wherein the collecting location comprises a cover folder feeder.

11. The device according to claim 1, wherein between the feeding device and the stitching location a cover folder feeder is provided.

12. The device according to claim 1, wherein the feeding device is a printed sheet feeder provided with the opening device.

13. The device according to claim 1, further comprising a computer-controlled control device.

* * * * *